US006681835B2

(12) United States Patent
Maeyama et al.

(10) Patent No.: US 6,681,835 B2
(45) Date of Patent: Jan. 27, 2004

(54) METHOD AND APPARATUS FOR MANUFACTURING SUPERCHARGER ROTOR

(75) Inventors: Mitsushi Maeyama, Chiba (JP); Yoshiyuki Miyagi, Ichikawa (JP); Shigeru Takabe, Sagamihara (JP); Masahiro Makita, Fuchu (JP); Masayoshi Sasaki, Fuchu (JP); Tatsuya Fujii, Fuchu (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 7 days.

(21) Appl. No.: 10/123,140

(22) Filed: Apr. 17, 2002

(65) Prior Publication Data

US 2002/0157801 A1 Oct. 31, 2002

(30) Foreign Application Priority Data

Apr. 27, 2001 (JP) ..... 2001-130781
Apr. 27, 2001 (JP) ..... 2001-130792

(51) Int. Cl.[7] ..... B22D 17/00; B22D 29/00; B22D 33/04

(52) U.S. Cl. ..... 164/113; 164/132; 164/312; 164/345

(58) Field of Search ..... 164/113, 312, 164/132, 137, 340, 369, 345

(56) References Cited

U.S. PATENT DOCUMENTS 4,761,124 A * 8/1988 Timuska et al. ..... 418/153
4,899,799 A * 2/1990 Drazy ..... 164/34
5,743,321 A * 4/1998 Joern et al. ..... 164/44
5,772,418 A * 6/1998 Tateno et al. ..... 418/206.5

FOREIGN PATENT DOCUMENTS

JP 63-192532 * 8/1988 ..... B22C/9/06
JP 7-301211 11/1995
JP 9-247877 9/1997

* cited by examiner

*Primary Examiner*—M. Alexandra Elve
*Assistant Examiner*—Kevin P. Kerns
(74) *Attorney, Agent, or Firm*—Griffin & Szipl

(57) ABSTRACT

A plurality of profile portion divided metal molds 12 surround a profile portion 11*a* of a supercharger rotor 11 to allow division. A pair of end metal molds 14 and 15 surround both ends of the rotor. A helical core 16 is attached to one end metal mold 14 so as to be helically passed through the profile portion of the rotor. A rotor-shaped cavity 13 is formed inside by the profile portion divided metal molds, and the end metal molds. Hot metal is pressurized, and injected and solidified in the cavity. Then, the end metal mold 14 having the helical core is pulled out by being rotated along a helical line.

5 Claims, 6 Drawing Sheets

METHOD AND APPARATUS FOR MANUFACTURING SUPERCHARGER ROTOR

BACKGROUND OF THE INVENTION

1. Field of the Invention

The present invention relates to a method and an apparatus for manufacturing a supercharger rotor.

2. Description of the Related Art

FIG. 1 is a schematic view of a supercharger rotor. The supercharger rotor comprises male rotor (M rotor 1) and female rotor (F rotor 2) rotated while being engaged with each other. The male rotor 1 includes a plurality (three in the drawing) of helical convex portions 1*a*, and the female rotor 2 includes helical concave portions 2*a* engaged with the helical convex portions 1*a* with no gap. Gas (e.g., air) is compressed between the helical convex and concave portions 1*a* and 2*a*, and the air is pressurized to supercharge in an internal combustion engine.

The supercharger rotor also comprises a profile portion 3 having the helical portions 1*a* and 2*a*, and a shaft 4 penetrating the profile portion 3. The profile portion 3 is normally made of aluminum, and the shaft 4 of steel. Accordingly, in order to firmly connect the profile portion 3 with the shaft 4, conventionally, metal bonding means has been employed to execute aluminizing for the shaft side, and connecting the shaft made of steel with the profile portion made of aluminum. In this case, since the shaft 4 and the profile portion 3 are connected with each other by metal bonding, the rotor must be maintained at a high temperature for a long time.

Conventionally, the supercharger has been manufactured by gravity casting or precision casting.

The gravity casting is a method of manufacturing a rotor by pouring molten metal (hot metal) into a mold, and solidifying it. For the mold, a sand mold or a metal mold is most often used. The mold has a cavity portion equivalent to a product (rotor in this case), and hot metal can be poured into this portion.

For the gravity casting, in the case of mass production, automization has been pursued in various manners. Still, however, manufacturing of a die or its disassembling takes time (e.g., about 6 min.), lowering productivity. Since feeder head twice as much as a product is necessary, lowering yield, and increasing costs. Because of low accuracy of a casting, an excess thickness of about 3 mm is necessary, accordingly increasing a processing margin, which result in longer processing time, and higher processing costs. Further, it is difficult to provide a helical hollow portion inside the rotor having the helical portion, consequently making the rotor heavy. Thus, the conventional rotor has many drawbacks such as a large moment of inertia, unsuitable for high-speed rotation and operation stop characteristics, and low response to an engine speed.

On the other hand, the precision casting is a shell mold method or a lost wax method, and characterized by high accuracy of a casting. However, it is substantially impossible to manufacture a rotor by the shell mold method. In addition the lost wax method includes many steps, lowering productivity, and increasing costs. Further, although the helical portion can be made hollow or the shaft can be cast-coated, costs are higher.

In order to solve the above-described connection problem by the aluminizing, means has been provided to fix a profile portion and a shaft to each other by a pin, or provide a groove 5 in a shaft 4, and cast-coat it as shown in FIG. 2A (Japanese Patent Application Laid-Open No. 301211/1995), or means has been presented to provide a through-hole 6 in a shaft 4, and cast-coat it (Japanese Patent Application No. 49677/1996). In these means, however, problems of high costs caused by increases in processing steps and components have been inherent.

SUMMARY OF THE INVENTION

The present invention was made to solve the foregoing problems. Specifically, a first object of the present invention is to provide a method and an apparatus for manufacturing a supercharger rotor, which is capable of inexpensively and efficiently manufacturing a rotor for a supercharger, reducing costs by greatly reducing a processing margin, and enhancing high-speed rotation and operation stop characteristics, and response to an engine speed by greatly reducing weight. A second object of the present invention is to provide a method for manufacturing a supercharger rotor, which is capable of inexpensively, efficiently and firmly connecting a profile portion and a shaft, constituting the supercharger rotor, with each other.

In order to achieve the first object, in accordance with the present invention, there is provided a method for manufacturing a supercharger rotor, a plurality of profile portion divided metal molds (12) surrounding a profile portion (11*a*) of a supercharger rotor (11) to allow division, and a pair of end metal molds (14, 15) surrounding both ends (11*b*) of the rotor being provided, and a helical core (16) helically passed through the profile portion of the rotor being attached to one end metal mold (14), the method comprising the steps of: (A) forming a rotor-shaped cavity (13) inside by the profile portion divided metal molds and the end metal molds; (B) pressurizing hot metal, and injecting and solidifying the hot metal in the cavity; and (C) pulling out the end metal mold (14) having a helical core by rotating the same along a helical line.

In accordance with the present invention, there is provided an apparatus for manufacturing a supercharger rotor, comprising: a plurality of profile portion divided metal molds (12) surrounding a profile portion (11*a*) of a supercharger rotor (11) to allow division; a pair of end metal molds (14, 15) surrounding both ends of the rotor; a helical core (16) attached to one end metal mold (14) to be helically passed through the profile portion of the rotor; and a rotary pulling-out device (18) for pulling out the end metal mold (14) having the helical core by rotating the same along a helical line.

According to the method and the apparatus of the present invention, by die-casting for forming the rotor-shaped cavity (13) inside with the metal molds (12, 14 and 15), and pressuring hot metal (e.g., aluminum), and injecting and solidifying the hot metal in the cavity, it is possible to manufacture a supercharger rotor inexpensively and efficiently.

By attaching the helical core (16) to one end metal mold (14) so as to be helically passed through the profile portion of the rotor, and pulling the end metal mold (14) by rotating the same along a helical line, the rotor can be made hollow. Thus, the hollow shape enables the rotor to be made thin, casting defect inherent in die-casting to be prevented, weight to be greatly reduced, and a moment of inertia to be reduced. As a result, it is possible to enhance high-speed rotation and operation stop characteristics, and response to the engine.

Furthermore, compared with gravity casting, in die-casting, there are no feeder heads, and accuracy is high.

Thus, it is possible to reduce processing costs by making an extra thickness small (e.g., about 0.5 mm), and greatly reducing a processing margin.

According to a preferred embodiment of the present invention, for the helical core (16), sectional shapes orthogonal to a rotor shaft are similar, and an attached portion to the end metal mold (14) is formed thick, and gradually made thinner toward a tip.

With such a constitution, when the rotary pulling-out device (18) pulls out the end metal mold (14) by rotating the same along the helical line, a casting rotor and the helical core (16) can be smoothly separated from each other (mold releasing), increasing die-casting productivity.

In order to achieve the second object, in accordance with the present invention, there is provided a method for manufacturing a supercharger rotor by casting a profile portion (21*a*) of a supercharger rotor (21) and a shaft (22) penetrating the same, comprising the steps of: (D) first processing a left and right helical cross portion (23) on a surface of the shaft connected to the profile portion; and (E) casting the profile portion (21*a*) around the shaft in die-casting.

According to a preferred embodiment of the present invention, the left and right helical cross portion (23) includes a right handed screw helical groove, and a left handed screw helical groove, and these grooves are caused to cross each other.

According to the method of the present invention, by forming a groove in the shaft, when casting is executed in die-casting, aluminum is surely injected by a casting pressure into the cross groove portion (23) formed on the surface of the shaft 22, and a sufficient fastening force is provided by mechanical connection.

Therefore, the conventional aluminizing to the shaft side is made unnecessary, and groove formation and penetrating are also made unnecessary. The number of processing steps is accordingly reduced, and extra components are made unnecessary. As a result, it is possible to firmly connect the profile portion and the shaft with each other inexpensively and efficiently.

Other objects and advantageous features of the present invention will become apparent by the following description made with reference to the accompanying drawings.

DESCRIPTION OF THE PREFERRED EMBODIMENTS

Figure 1:
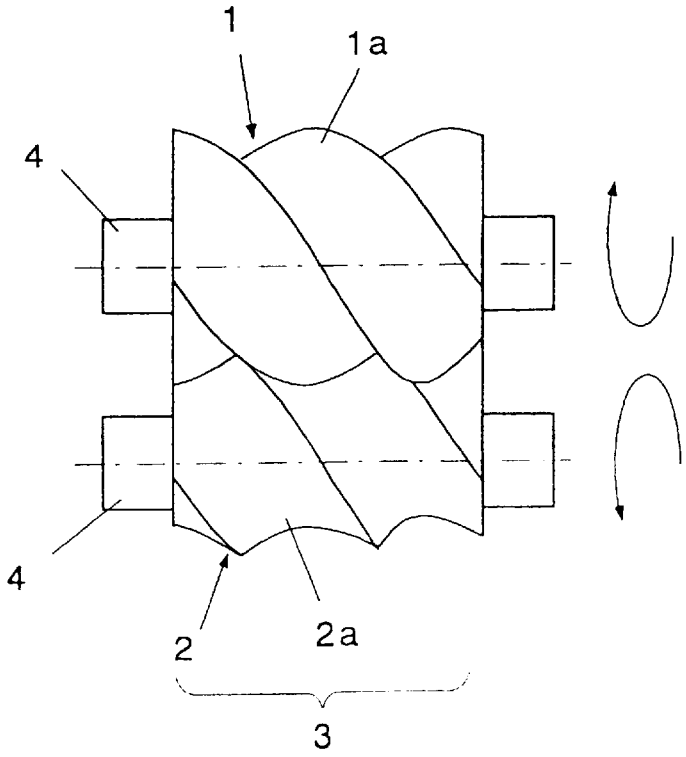
Fig.1 PRIOR ART
FIG. 1 is a schematic view of a supercharger rotor.
Figure 2A:
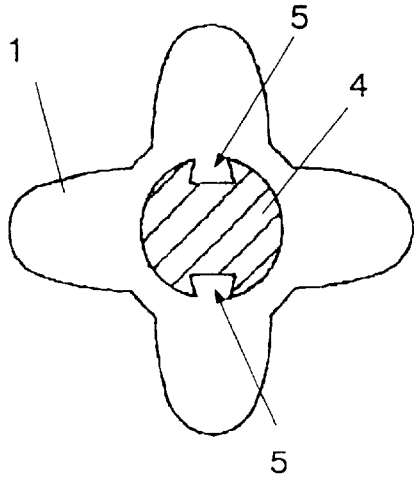
Fig.2A PRIOR ART
FIGS. 2A and 2B are schematic views, each showing a conventional casting method.
Figure 2B:
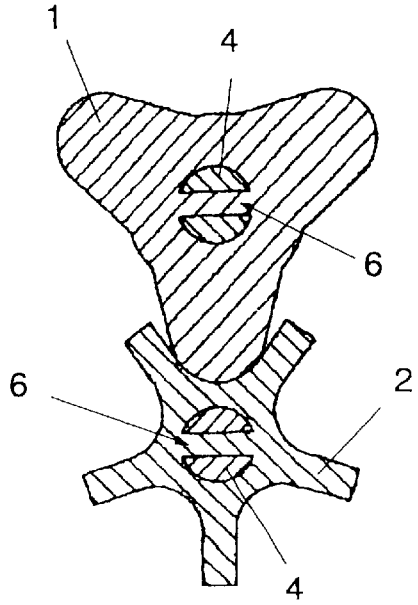
Fig.2B PRIOR ART

Next, description will be made of the preferred embodiments of the present invention with reference to the accompanying drawings. Same components in the drawings will be denoted by same reference numerals, and overlapped explanation will be omitted.

Figure 3:
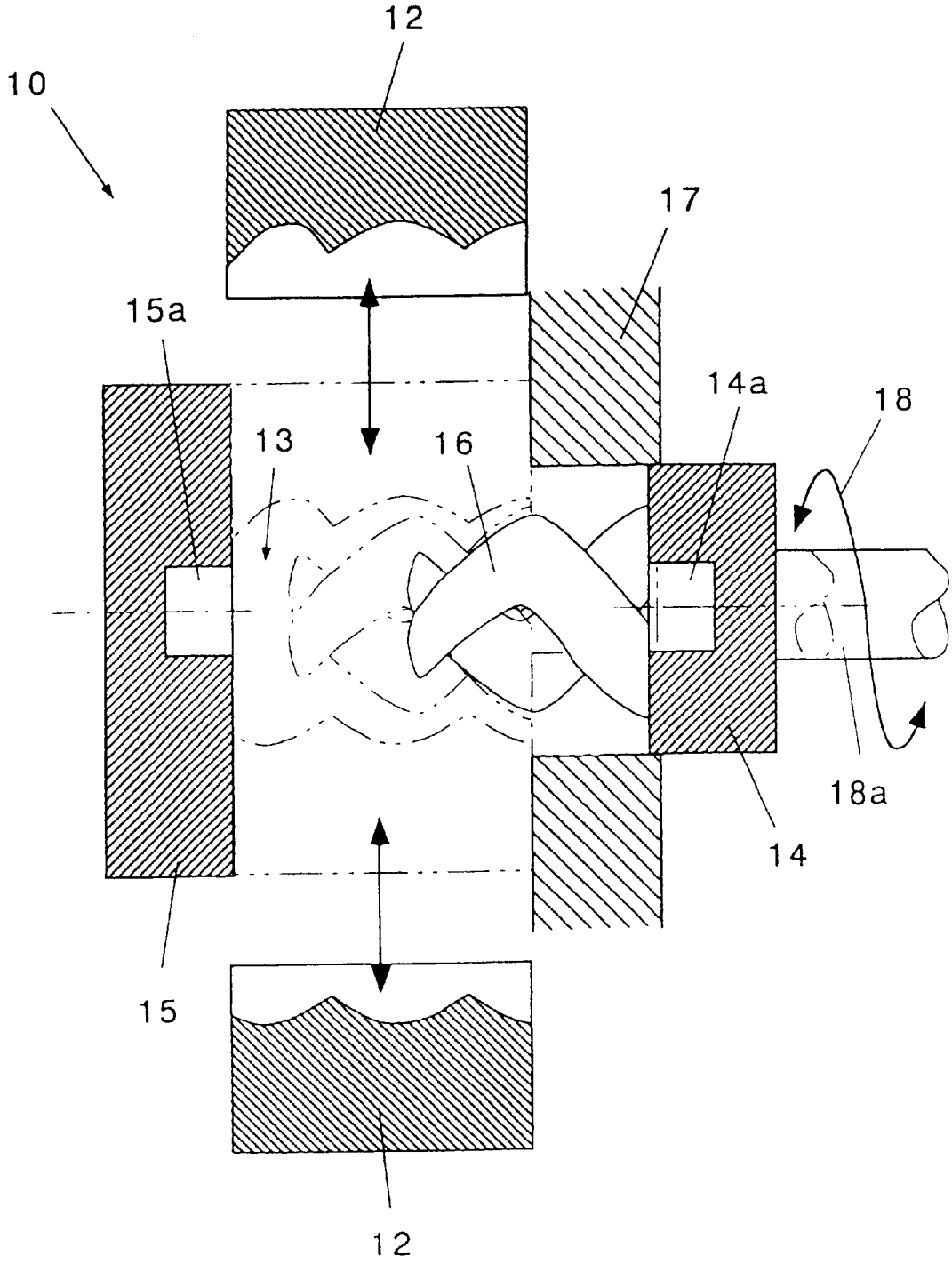
FIG. 3 is an entire constitutional view of an apparatus for manufacturing a supercharger rotor according to the present invention.

FIG. 3 is an entire constitutional view of an apparatus for manufacturing a supercharger rotor according to the present invention. As shown, a rotor manufacturing apparatus 10 of the present invention comprises a plurality of profile portion divided metal molds 12, a pair of end metal molds 14 and 15, and a rotary pulling-out device 18.

The plurality (e.g., 4 divisions) of profile portion divided metal molds 12 surround a profile portion 11*a* (not shown, see FIG. 4B) of a supercharger rotor 11 so as to allow its division, and form a cavity 13 equivalent to the profile portion 11*a* inside. Hot metal can be injected through a hot metal path into the cavity 13. Each profile portion divided metal mold 12 can be moved in a direction orthogonal to a rotor shaft between a casting position (indicated by two-dot chain line) and a separating position (indicated by solid line).

The pair of end metal molds 14 and 15 respectively have shaft cavities 14*a* and 15*a* for housing the rotor shaft. The rotor shaft (not shown) having a left and right handed helical cross portion formed on a surface in a range of being shorter than a body length of the profile portion 11*a* is fitted in the cavities. In this state, the cavity 13 equivalent to the body length and a body outer periphery of the profile portion forming both ends 11*b* (not shown, see FIG. 4) of the rotor is formed.

One end metal mold 14 positioned in a right side of the drawing has a helical core 16 attached to pass through the cavity 13 equivalent to the profile portion of the rotor. A plurality of helical cores 16 are provided corresponding to helical portions (twisted portions) of the rotor.

Sectional shapes orthogonal to the rotor shaft are formed to be similar such that a casting rotor and the helical core 16 can be smoothly separated from each other (mold releasing) when the helical core 16 is pulled out by being rotated along a helical line. Also, for a similar purpose, an attached part of the helical core 16 to the end metal mold 14 is formed thick, and made gradually thinner toward a tip (left side in the drawing).

The rotary pulling-out device 18 pulls out the end metal mold 14 having the above-described helical core by rotating it along the helical line. This rotary pulling-out device 18 includes, for example, a rotary shaft 18*a* attached to the end metal mold 14 and extended in an axial direction, a helical guide (not shown) for guiding the rotary shaft 18*a* along a helical line similar to that of the helical core, and a rack and pinion device (not shown) for rotating the rotary shaft 18*a* around an axial center. In the drawing, a reference numeral 17 denotes a guide plate for the end metal mold 14 having the helical core, and the helical guide, not shown, may be provided in this guide plate.

Figure 4A:
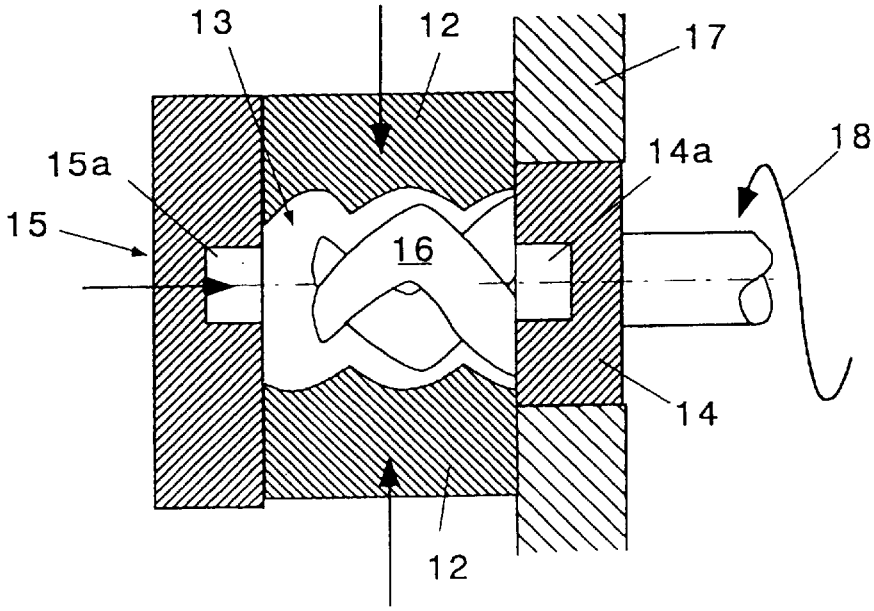
FIGS. 4A and 4B are explanatory views, each showing a manufacturing method according to a first embodiment of the present invention.
Figure 4B:
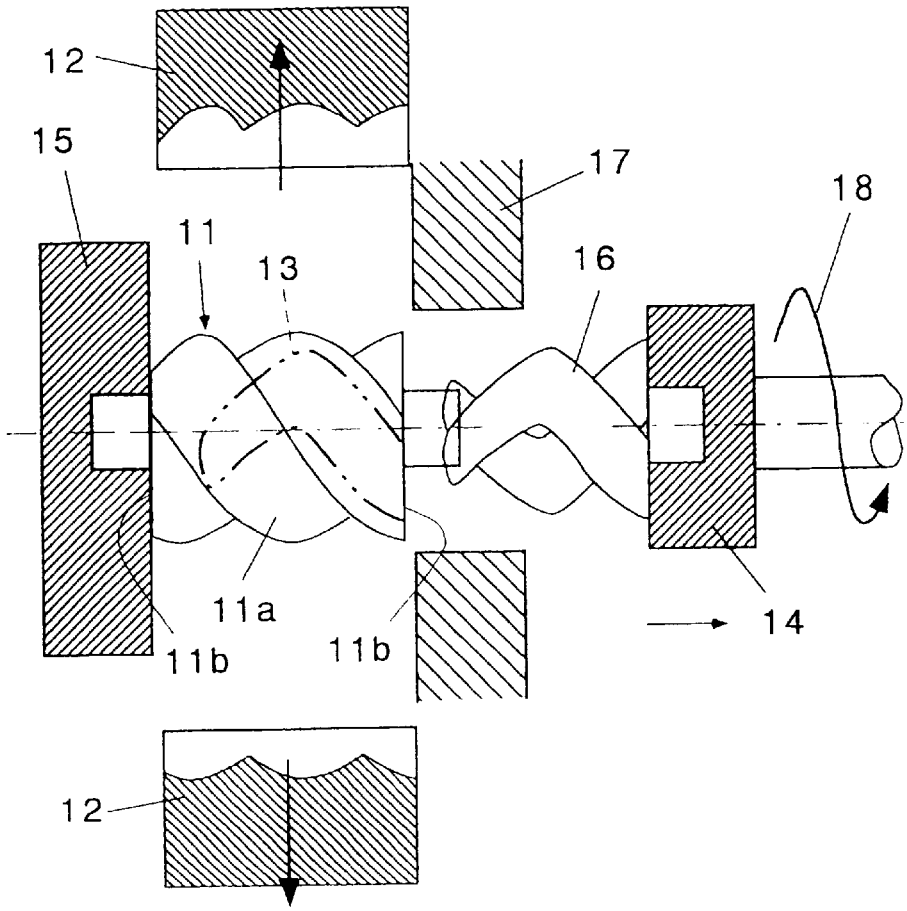

FIGS. 4A and 4B are explanatory views, each showing a manufacturing method according to a first embodiment of the present invention: FIG. 4A showing casting (die-casting), and FIG. 4B metal mold separation.

As shown, the method for manufacturing a supercharger rotor according to the present invention comprises: (A) a cavity formation step of forming a rotor-shaped cavity 13 inside by a profile portion divided metal mold 12 and end metal molds 14 and 15, using the above-described apparatus; (B) an injection and solidification step of pressurizing hot metal, and injecting and solidifying it in the cavity 13; and (C) a metal mold separation step of pulling out the end metal mold 14 having a helical core by rotating it along a helical line. Separation of the profile portion divided metal mold 12 and the end metal mold 15 from each other may be executed simultaneously with the metal mold separation step, or in another step.

In the manufacturing method of the supercharger rotor of the present invention, before the cavity formation step (A), a rotor shaft processing step may be provided to process a left and right helical cross portion on a surface of the rotor shaft in a range shorter than a body length of a profile portion 11*a*. This left and right helical cross portion includes a right handed screw helical groove and a left handed screw helical groove cut by, for example, a lathe. The cross portion is formed by crossing these with each other. The screw by cutting is a 10-thread screw having a pitch of, e.g., 1 mm, and has a normal angle shape. In lathe work, a plurality of cutting tools are used in parallel, and multiple thread screws are simultaneously processed or processed by shifting cutter positions by a plurality of times. Other than cutting by using the lathe, for example, knurling may be carried out. By providing the rotor shaft processing step of forming the left and right cross portion on the surface of the rotor shaft in the range shorter than the body length of the profile portion 11*a*, when the rotor shaft is cast-coated in die-casting, aluminum is injected by a casting pressure into the cross groove portion formed on the surface of the rotor shaft, and a sufficient fastening force is provided by mechanical connection.

According to the above-described method and apparatus of the present invention, it is possible to manufacture a supercharger rotor inexpensively and efficiently by the die-casting for forming the rotor-shaped cavity 13 inside with the metal molds 12, 14 and 15, and injecting and solidifying hot metal (e.g., aluminum) in the cavity.

By attaching the helical core 16 helically passed through the profile portion of the rotor to one end metal mold 14, and pulling out the end metal mold 14 by rotating it along the helical line, the rotor can be made hollow in shape. The hollow shape enables the rotor to be made thin. Thus, it is possible to prevent casting defects inherent in die-casting, greatly reduce weight, and enhance high-speed rotation and operation stop characteristics by reducing a moment of inertia, and response to an engine speed.

Moreover, compared with the gravity casting, in the die-casting, there are no feeder heads, and accuracy is high. Thus, by reducing an extra thickness (e.g., about 0.5 mm), and greatly reducing a processing margin, it is possible to reduce processing costs.

Figure 5A:
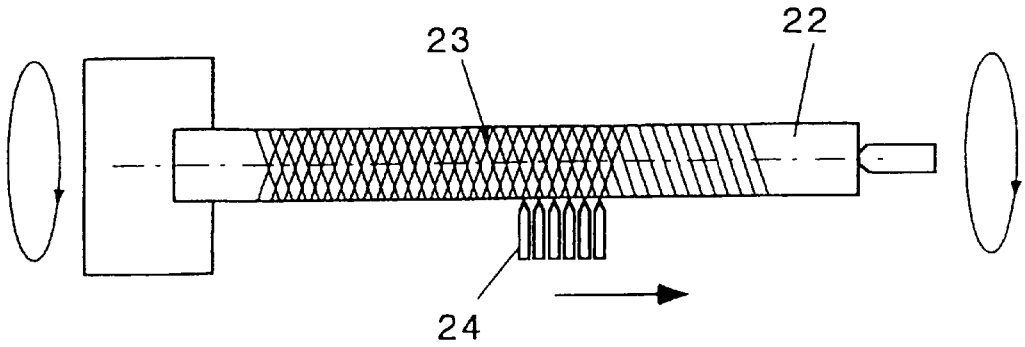
FIGS. 5A and 5B are explanatory views, each showing a manufacturing method according to a second embodiment of the present invention.
Figure 5B:
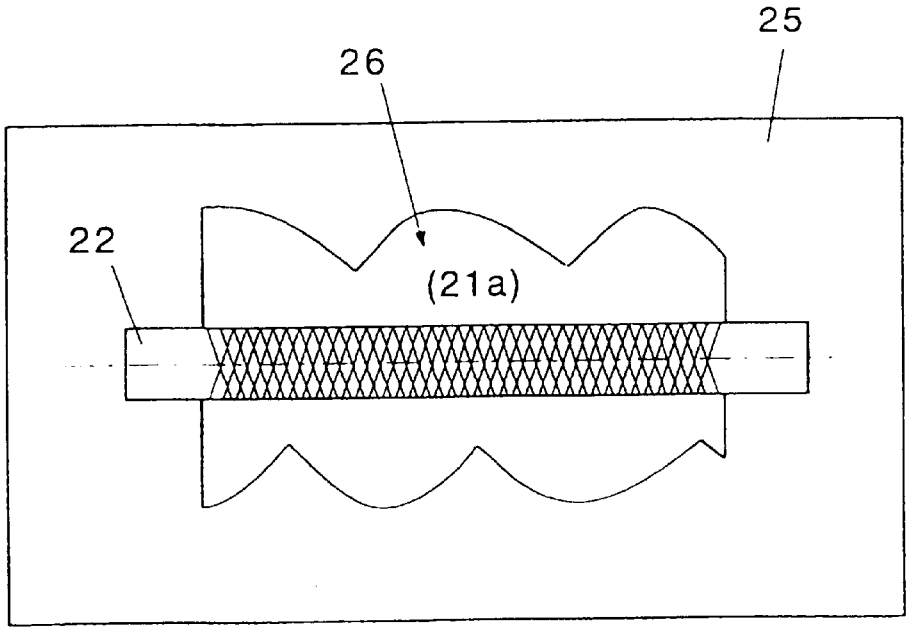

FIGS. 5A and 5B are explanatory views, each showing a manufacturing method according to a second embodiment of the present invention: FIG. 5A showing a cross portion processing step, and FIG. 5B a casting step.

In the cross portion processing step of FIG. 5A, a left and right helical cross portion 23 is formed on a surface of a shaft 22 penetrating a profile portion of a supercharger rotor in a range shorter than a body length of a profile portion 21*a*. This left and right helical cross portion 23 includes a right handed screw helical groove and a left handed screw helical groove cut by, for example, a lathe. The cross portion is formed by crossing these with each other. The screw by cutting is a 10-thread screw having a pitch of, e.g., 1 mm, and has a normal angle shape. In lathe work, a plurality of cutting tools 24 are used in parallel, and multiple thread screws are simultaneously processed or processed by shifting cutter positions by a plurality of times.

Other than cutting by using the lathe, for example knurling may be carried out. However, the cross portion 23 can be processed more efficiently within a shorter time in the screw processing by the lathe than in the knurling.

In the casting step of FIG. 5B, the shaft 22 having the cross portion 23 processed is surrounded with a metal mold 25, and hot metal such as aluminum is injected by a high pressure through a hot metal path into a cavity 26 inside. The hot metal is solidified in the cavity 26 within a short time, completing a supercharger rotor having the shaft 22 cast-coated in the profile portion 21*a*.

Figure 6A:
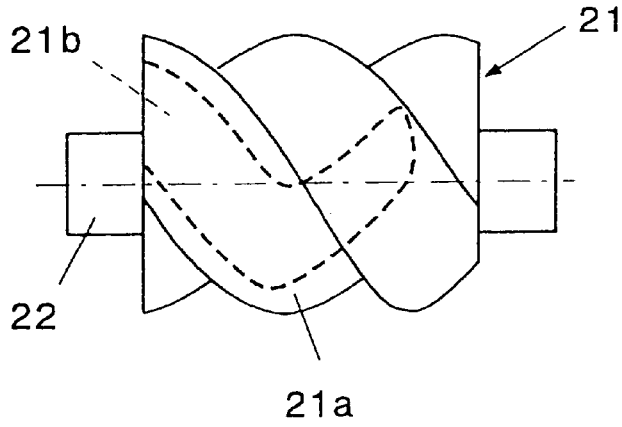
FIGS. 6A to 6C are schematic views, each showing a rotor manufactured by the method shown in each of FIGS. 5A and 5B.
Figure 6B:
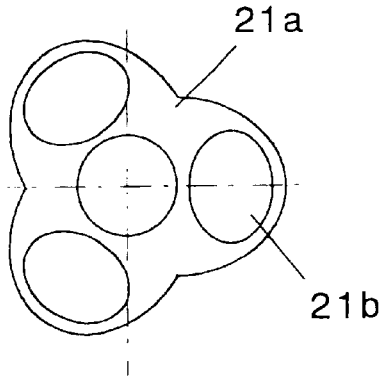
Figure 6C:
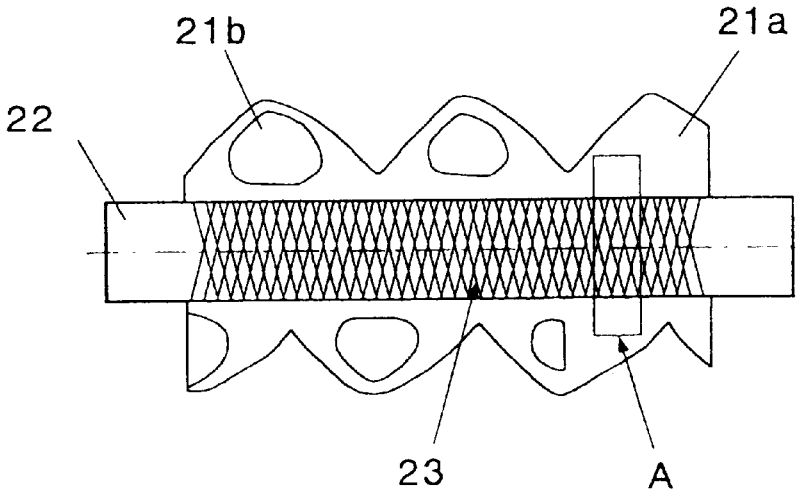

FIGS. 6A to 6C are schematic views, each showing a rotor manufactured by the method shown in each of FIGS. 5A and 5B: FIG. 6A being a side view, FIG. 6B an end view, and FIG. 6C a transverse sectional view of an actually manufactured rotor.

The rotor shown in each of FIGS. 6A to 6C includes a hollow portion 21*b* in a profile portion 21*a*. The hollow shape enables the rotor to be made thin. Thus, it is possible to prevent casting defects inherent in the die-casting, greatly reduce weight, and enhance high-speed rotation and operation stop characteristics by reducing a moment of inertia, and response to an engine speed.

Figure 7:
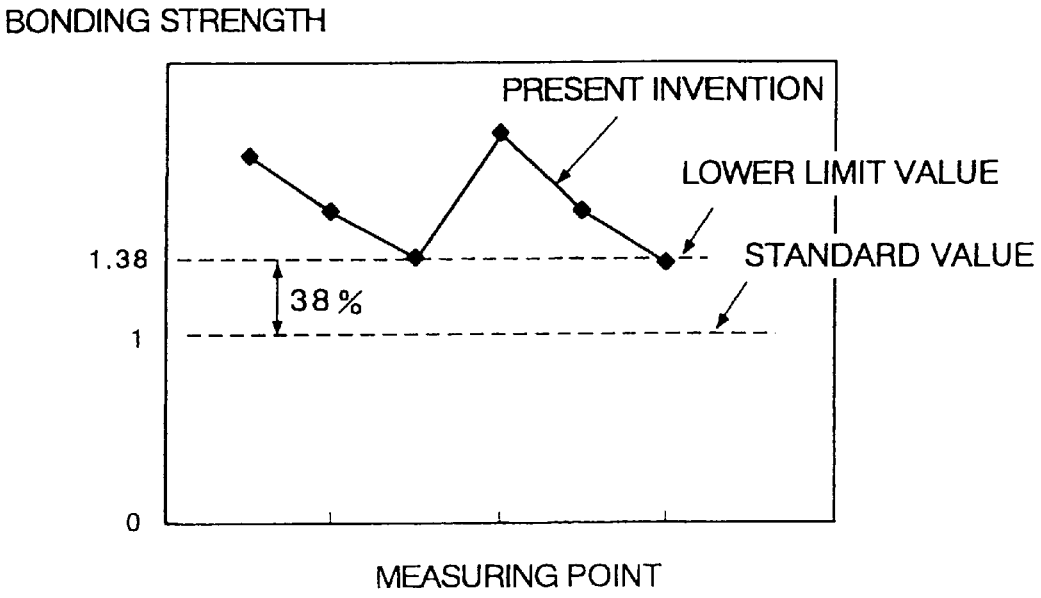
FIG. 7 is a view showing a testing result of the rotor manufactured by the method shown in each of FIGS. 5A and 5B.

FIG. 7 shows a testing result of the rotor manufactured by the method shown in each of FIGS. 5A and 5B. This testing was carried out in a manner that by the above-described method, the profile portion and the shaft of the rotor were cast-coated by aluminum die-casting, portions indicated by an arrow A of FIG. 6C were cut out from six places of an axial direction, and a bonding strength of each was measured.

An ordinate of FIG. 7 indicates a load measured when a portion A including the profile portion and the shaft is cut out from the manufactured rotor, an axial force is applied on the shaft supporting the profile portion, and the shaft is pulled out from the profile portion. In this case, the load is represented by a bonding strength per an axial length.

The drawing shows that by the method of the present invention, when standard value of a bonding strength required by the supercharger rotor is 1, a lower limit value of a bonding strength by the present invention is 1.38, and a bonding strength higher by at least ≧38% than conventionally can be obtained.

Also, in the testing, as a sample-measuring of a bonding strength between the profile proportion and the shaft, i.e., hardness of the profile portion around the shaft, sufficiently high hardness was discovered in an axial peripheral portion, in which defects easily occurred conventionally.

According to the above-described method of the present invention, by forming a groove in the shaft 22, when casting is executed in die-casting, aluminum is injected by a casting pressure into the cross groove portion 23 formed on the surface of the shaft 22, and a sufficient fastening force is provided by mechanical connection. Therefore, the conventional aluminizing to the shaft side is made unnecessary, and groove formation and penetrating are also made unnecessary. The number of processing steps is accordingly reduced, and extra components are made unnecessary. As a result, it is possible to firmly connect the profile portion and the shaft with each other inexpensively and efficiently.

As apparent from the foregoing, the method and the apparatus of the present invention are highly advantageous in that it is possible to manufacture a supercharger rotor inexpensively and efficiently, it is possible to enhance high-speed rotation and operation stop characteristics, and response to the engine by greatly reducing a processing margin to reduce processing costs, and greatly reducing weight, and it is possible to firmly connect the profile portion and the shaft constituting the supercharger rotor with each other inexpensively and efficiently.

The present invention is not limited to the foregoing embodiments and, needless to say, various changes and modifications can be made without departing from the teachings of the present invention.

What is claimed is:

1. A method for manufacturing a supercharger rotor, providing;

a plurality of profile portion divided metal molds surrounding a profile portion of a supercharger rotor to allow division, a pair of end metal molds surrounding both ends of the rotor, and a helical core helically passed through the profile portion of the rotor being attached to one end metal mold, the method further comprising the steps of:

(A) forming a rotor-shaped cavity inside by the profile portion divided metal molds and the end metal molds;

(B) pressurizing hot metal, and injecting and solidifying the hot metal in the cavity; and (C) pulling out the end metal mold having a helical core by rotating the same along a helical line.

2. An apparatus for manufacturing a supercharger rotor, comprising:

a plurality of profile portion divided metal molds surrounding a profile portion of a supercharger rotor to allow division;

a pair of end metal molds surrounding both ends of the rotor;

a helical core attached to one end metal mold to be helically passed through the profile portion of the rotor; and a rotary pulling-out device for pulling out the end metal mold having the helical core by rotating the same along a helical line.

3. An apparatus according to claim 2, wherein for the helical core, sectional shapes orthogonal to a rotor shaft are similar, and an attached portion to the end metal mold is formed thick, and gradually made thinner toward a tip.

4. A method for manufacturing a supercharger rotor, providing;

an apparatus for manufacturing a supercharger rotor, comprising:

(A) a plurality of profile portion divided metal molds surrounding a profile portion of a supercharger rotor to allow division;

(B) a pair of end metal molds surrounding both ends of the rotor;

(C) a helical core attached to one end metal mold to be helically passed through the profile portion of the rotor; and (D) a rotary pulling-out device for pulling out the end metal mold having the helical core by rotating the same along a helical line;

the method further comprising the steps of:

(A) forming a rotor-shaped cavity inside by the profile portion divided metal molds and the end metal molds;

(B) pressurizing hot metal, and injecting and solidifying said hot metal in said cavity; and (C) pulling out said end metal mold having a helical core by rotating the same along a helical line.

5. The method of claim 1, wherein said providing step consists of providing an apparatus for manufacturing a supercharger rotor, comprising:

a plurality of profile portion divided metal molds surrounding a profile portion of a supercharger rotor to allow division;

a pair of end metal molds surrounding both ends of the rotor;

a helical core attached to one end metal mold to be helically passed through the profile portion of the rotor; and a rotary pulling-out device for pulling out the end metal mold having the helical core by rotating the same along a helical line.

* * * * *